United States Patent [19]

Rasekhi et al.

[11] 4,378,754

[45] Apr. 5, 1983

[54] TONER APPLICATOR SYSTEM FOR MAGNETOGRAPHY

[75] Inventors: Houshang Rasekhi, Convent Station, N.J.; Alfred M. Nelson, Redondo Beach, Calif.; John S. Kula, Jr., Budd Lake; John J. Sudano, Paterson, both of N.J.

[73] Assignee: Wang Laboratories, Inc., Lowell, Mass.

[21] Appl. No.: 290,274

[22] Filed: Aug. 5, 1981

[51] Int. Cl.[3] ..... G03G 15/09

[52] U.S. Cl. ..... 118/658; 118/644; 118/657

[58] Field of Search ..... 118/657, 658, 623, 644; 427/47

[56] References Cited

U.S. PATENT DOCUMENTS

| | | | |
|---|---|---|---|
| 2,857,879 | 10/1958 | Johnson | 118/623 |
| 2,930,351 | 3/1960 | Giaimo | 118/623 |
| 3,703,395 | 11/1972 | Drexler et al. | 427/47 |
| 3,945,343 | 3/1976 | Berkowitz | 118/623 |
| 4,121,931 | 10/1978 | Nelson | 118/658 |

*Primary Examiner*—Bernard D. Pianalto

*Attorney, Agent, or Firm*—Michael H. Shanahan

[57] ABSTRACT

In a high-quality, high-speed magnetographic apparatus, an arrangement for developing the latent magnetic images of a readily-imagable magnetizable medium (in particular a relatively high-coercivity medium) with magnetically attractable toner particles. A rotatable toner developer is positioned proximate to the medium to define therebetween a toning zone, with the developer being structured to magnetically provide toner particles in contact with the medium at the toning zone and to impart to the toner particles at least at and approaching the toning zone a direction of movement relative to the medium which is in opposition to the latter. A concentration of substantially fluidized and magnetically confined toner particles is thus provided which is urged into contact with the medium for effectively developing the latent images even with the medium moving at high speed relative to the developer and without adversely affecting the latent magnetic images of the medium. A magnetic field enhancer is positioned proximate to the toning zone on the opposite side of the magnetic medium from the developer, which effectively enhances the shape of the magnetic field at the toning zone in the general direction toward the magnetic medium thereby increasing the magnetically generated toner contact pressure. A scavenger arrangement is included for collecting any air-borne toner, for removing excess toner residing on the developed image areas of the medium, and for removing stray toner particles residing on the non-imaged areas and the back of the medium. The continuity of toning provided to the medium is facilitated by an eccentrically operated toner rake arrangement situated in the toner bin for urging the toner particles in the toner bin toward the developer. Alternatively, the toner can be rendered fluidized by a oscillating floor or wall arrangement resiliently coupled to the remainder of the toner bin. The developer is provided with a channel arrangement governing the approach of the toner particles thereto which are received from the action of say the toner rake. The channel arrangement ensures that the toner is introduced to the developer in a well defined narrow band the width dimension of which is commensurate with the width of the desired imaged portion of the magnetic medium. The developer station is particularly effective in both a substantially horizontal orientation, underneath the magnetic medium, and at a substantially vertical angle and proximate to the outside surface of the medium.

9 Claims, 12 Drawing Figures

TONER APPLICATOR SYSTEM FOR MAGNETOGRAPHY

BACKGROUND OF THE INVENTION

This invention relates to toning systems in magnetographic printing and more specifically to improvements in the arrangement of a toning system for transferring dry particulate magnetic toner to magnetic latent images on a magnetic medium, taking into particular consideration the development of high quality images and efficiency of toning.

In electrophotography, the transfer of a proper amount of dry magnetic toner to the photoconductor substrate bearing the electrostatic latent image is accomplished by carefully balancing the electrostatic forces of the latent image against the magnetic forces of the applicator exerted on electrically charged toner particles. For example, a decrease in the magnetic forces of the applicator causes an increase in the amount of toner transferred to the latent image. Notwithstanding, arrangements have been proposed whereby the so-called lead magnet of the applicator, i.e. the magnet positioned to be primarily responsible for governing the toner transfer to the medium, has been located as close as practically possible to the photoconductor substrate and oriented with a pole face thereof fully facing the substrate to provide a perpendicular magnetic field relative to the latter.

In magnetography, one of the more effective techniques of transferring toner to a magnetic latent image carried on a medium is described in U.S. Pat. No. 4,197,811 to Nelson. In this technique the magnetic latent image is subjected to a free flowing amount of dry magnetic toner particles, and subsequently the excess toner deposited on the magnetic latent images is removed by properly controlled forces of air flowing over the toned images. Such a system is capable of providing high quality toned images and does not require any magnetic fields to bring the toner into contact with the magnetic medium, and thus there is not danger of the magnetic fields of the applicator apparatus adversely affecting the latent magnetic images. However, for commercial utilization, this so-called free flow toner applicator has the disadvantage that involved and time consuming procedures are needed for replacing the magnetic substrate or medium. Also, toner gets behind tape and must be removed.

Another technique of transferring magnetic toner particles to a magnetic latent image is described in U.S. Pat. No. 3,945,343 (Berkowitz). In this magnetically controlled technique, apparently magnetic toner is transferred to the latent image by carefully controlling the magnetic forces, exerted on the toner particles, of the image and the applicator while the direction of a reduced applicator magnetic field provided by a pair of spaced magnets of the same magnetic polarity is maintained substantially perpendicular to the plane of the latent image to reduce the interaction of the two magnetic fields that could result in weakening (or destruction) of the magnetic latent image. It can be appreciated that in such a system the toner applicator may not interfere with the function of replacing the used magnetic substrate, as compared with the arrangement of the aforementioned U.S. Patent. However, transfer of a proper amount of toner to the magnetic latent image, without image degradation, for high quality print remains of substantial concern, especially when considering toning efficiency as one of the prime goals. That is, when the strength of the magnetic field of the applicator is adjusted upward for a proper amount of toner transfer (i.e. to ensure essentially no over-toning) the magnetic latent images on the magnetic substrate or medium tend to become weakened, which causes degradation in the quality of the toner image. While the problem can be addressed by selecting a magnetic recording medium with substantially higher values of coercive force, it can be appreciated, however, that such changes in the properties of the magnetic recording medium will create other difficulties in the recording functions.

In yet another known magnetic roll applicator arrangement, the pair of magnets of the applicator closest to the magnetic medium are spaced apart to provide a reduced magnetic field and yet are provided with a double-sided ramp member therebetween to mechanically urge the toner particles in a perpendicular direction toward and relative to the plane of the medium. Such an arrangement, however, does not satisfy the conditions of high quality toning at commercially desirable high speeds of operation due to toner starvation and excessive air borne toner escaping the toning zone.

Therefore, what is needed and would be useful is a toner applicator for transferring dry magnetic toner particles to a moving magnetic latent image with efficiency and without causing image degradation or machine contamination, to be utilizable in commercial high quality printing systems, and such is a principal object of this invention.

SUMMARY OF THE INVENTION

In accordance with the invention, this quest is solved particularly in connection with high quality, high speed magnetographic apparatus by providing an arrangement for developing the latent magnetic images of a readily-imagable magnetizable medium (in particular a relatively high-coercivity medium) with magnetically attractable toner particles, comprising toning means positioned proximate to the medium to define therebetween a toning zone, said toning means being structured to magnetically provide toner particles in contact with the medium at the toning zone and to impart to the toner particles at least at and approaching the toning zone a direction of movement relative to the medium which is in opposition to the latter, the structural relationship between the medium and the toning means defining in the toning zone a concentration of substantially fluidized and magnetically confined toner particles urged in contact with the medium for effectively developing the latent images even with the medium moving at high speed relative to said toning means and without adversely affecting the latent magnetic images of the medium.

In a particularly preferred embodiment a magnetic enhancer means is positioned proximate to the toning zone created by the magnetic applicator roll and on the opposite side of the magnetic medium therefrom. In this way, the shape of the magnetic field at the toning zone is effectively and advantageously enhanced in the general direction toward the magnetic medium thereby increasing the magnetically generated toner contact pressure. This magnetic enhancer can take the form of a suitably disposed and shaped piece of soft magnetic material, an electromagnet arrangement or a permanent magnet arrangement. In the latter case particularly, the magnetic enhancer can be extended away from the toning zone in the direction of travel of the magnetic medium. In this way a continued attracting magnetic influence is exerted on the toner now in contact with the imaged side of the medium by a means which remains saturated on the opposite side of the medium. Thus, the problem of air borne toner in particular is virtually eliminated.

The invention provides in addition means for rendering the developed images into a desired high quality, which comprises means for collecting any remaining air borne toner, for removing excess toner residing on the developed image areas of the medium, and for removing stray toner particles residing on the non-imaged areas. Such means includes a magnetic scavenger wheel suitably positioned proximate to the medium and downstream of the toning zone and the magnetic enhancer in the direction of movement of the medium. The scavenger or cleaning wheel is arranged so as not to adversely impact the latent magnetic images on the medium yet interacts particularly well with the extended magnetic enhancer to ensure a continuity of magnetic control on the toner particles riding on the tape, and the recycling of the excessively deposited toner particles to the toner bin. Such means also includes a pair of vacuum cleaning source arrangements each suitably disposed proximate to one of the sides of the medium. In the case of the vacuum arrangement associated to the back side of the medium, the arrangement is provided with a scraper blade. This back side vacuum arrangement is particularly effective in keeping the "drive-side" of the medium clean from dust and toner particles that would otherwise tend to eventually cause slippage in the medium's movement and thus a loss of registry with the remainder of the operating magnetographic system. The front side magnet is provided to remove any remaining excess toner and unwanted toner lying on the non-imaged areas of the medium.

The continuity of toning provided by the toner developer station in accordance with the invention is improved by an extremely simple yet effective eccentrically operated toner rake arrangement situated in the toner bin for urging the toner particles in the toner bin toward the magnetic roll. Alternatively, the toner can be rendered fluidized by a similarly simplified oscillating floor or wall arrangement resiliently coupled to the remainder of the toner bin.

With regard to the urging of the toner particles toward the magnetic roll, the developer station is provided with channel means governing the approach of the toner particles to the magnetic roll which are received from the action of say the toner rake. The channel means ensures that the toner is introduced to the magnetic roll in a well defined narrow band the width dimension of which is commensurate with the width of the desired imaged portion of the magnetic medium. The channel means is shaped to closely conform to the magnetic wheel and to provide a tapered or funneled channel that makes available the toner particles to the magnetic roll over fully a quarter of the circumference of the latter. In addition, the channel means provides an adjustable metering member that enables the operator to establish the desired depth of toner deposited on the magnetic roll as the toner approaches the toning zone.

The developer station constructed in accordance with the invention is particularly effective in both a substantially horizontal orientation, underneath the magnetic medium, and at a substantially vertical angle and proximate to the outside surface of the medium, as well as at any angle therebetween, to enable flexibility in system design.

BRIEF DESCRIPTION OF THE DRAWINGS

The above-mentioned and other objects and features will become better understood with reference to the following detailed description taken in conjunction with the accompanying drawings; in which.

DESCRIPTION OF THE PREFERRED EMBODIMENTS

Figure 1:
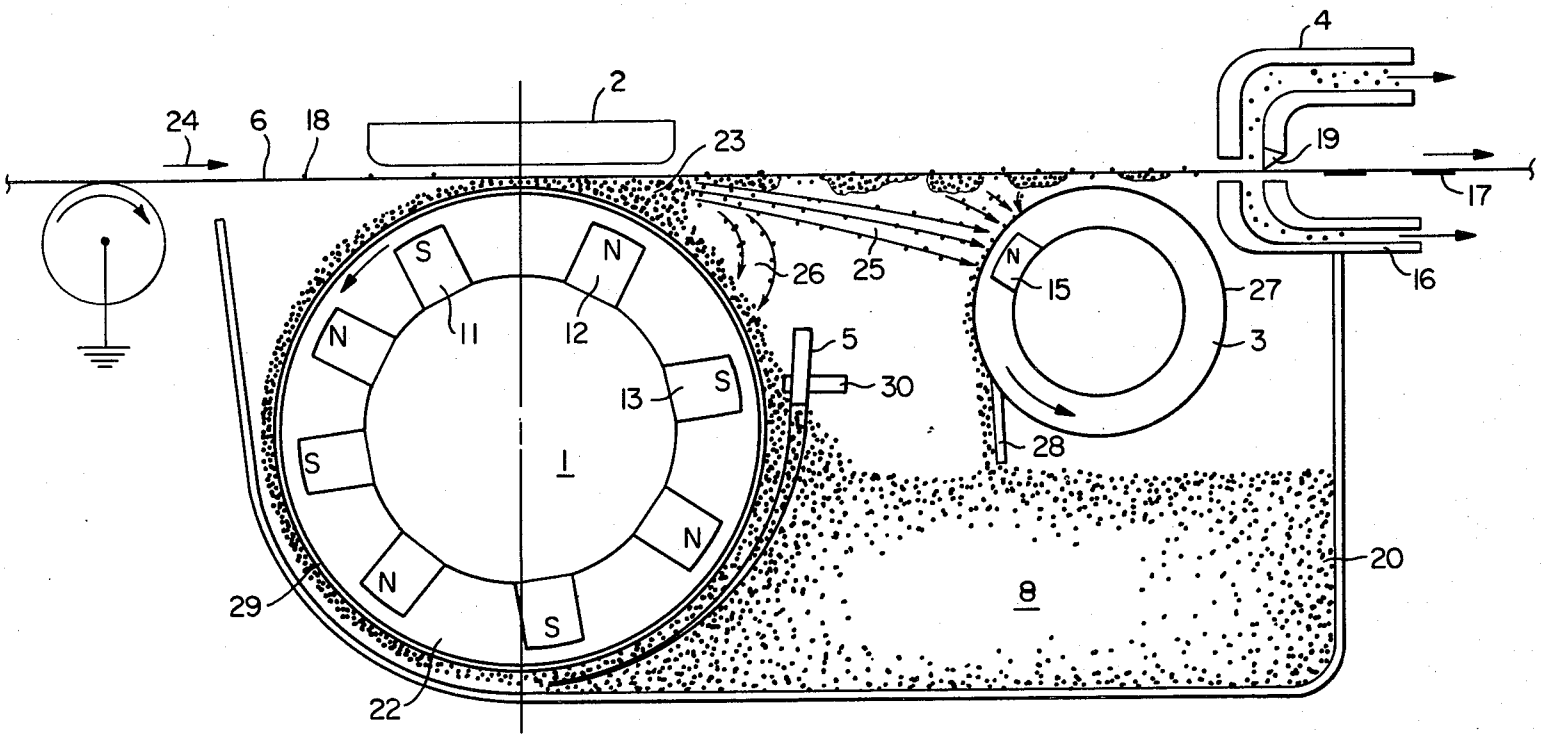
FIG. 1 conceptually illustrates in a side view a preferred embodiment of a toning system according to the invention.

FIG. 1 conceptually illustrates a cross-sectioned side view of a toning or developing module according to this invention. The depicted module is substantially horizontally oriented relative to and beneath a moving magnetic medium 6 (comprised of $CrO_2$ or cobalt-modified iron oxide) and performs the basic steps of first developing the images and then cleaning the developed images.

Toner particles 8 deposited (by means not shown) in a toner bin 20 are made available via a channeling means to a magnetic wheel or roll 22. Functionally, the main toner supply 20 includes means (not shown in FIG. 1) for urging toner 8 to within a relatively close distance of a magnetic roll 22, with the latter being designed to attract and transport toner to a toning zone 23. Magnetic roll 22 is comprised of several magnets (say 11, 12, 13, etc.) fixed on a stationary core 1 that is made of high permeability material, such as soft iron, and a rotating non-magnetic cylinder 29. The magnets are spaced about the periphery of the core 1 as shown with each having a pole face situated proximate the inside surface of the cylindrical shell 29. Each proximate pair of magnets (the pair comprising a given magnet and one of the two magnets positioned most proximate to it) is disposed such that each individual magnet of the pair occupies opposite pole positions for creating a magnetic field (such as shown in FIG. 2A). The magnetic toner particles 8 attracted by the magnetic field forces of these magnets will adhere to the outside surface of cylinder 29 which facilitates the toner transport function to the toning zone and back to the main toner supply.

The structure of the developer station or module is completed with a magnetic field enhancer 2 disposed above the magnetic tape 6 immediately over the location of toning zone 23 effected by the magnetic roll 22. Downstream of the location of magnetic wheel 22 and enhancer 2 in the direction of tape travel is a magnetic scavenger or cleaning wheel or roll 3 operatively disposed proximate to the tape 6. Therefollowing, a pair of vacuum arrangements 4 and 16 are provided, each operatively associated to one of the sides of the tape. The magnetic medium 6 moving in the direction indicated by arrow 24, that is in a direction opposite to that of the cylinder 29, is operatively situated at a relatively close (proximate) distance from the magnetic roll 22, such that at the toning zone 23 it comes into intimate contact with the magnetic toner particles 8, which thus adhere to the portion of the surface of the magnetic medium where magnetic latent images have been recorded.

As depicted in FIG. 1, as the toned magnetic medium (e.g. a magnetic tape) moves away from the toning zone it tends to generate air-borned toner particles 25 and 26 due to its high speed of movement (typically 40–55 inches per second). The air-borne toner is, however, eventually collected via the magnetic fields of the magnets 12, 13 and 15, the latter magnet being part of the cleaning wheel or roll 3. The field of the magnet 15 also attracts the excess toner particles associated with the toned images and the background (i.e. the non-imaged) areas. Thus the toned images leaving the cleaning or scavenging roll 3 carry a relatively small remaining amount of excess toner particles, which is subsequently removed by vacuum cleaner 16 without subjecting the magnetic images to any image-weakening magnetic fields. High quality toned images thus emerge from the developer station, with the magnetic tape at this point being substantially free of toned background.

Prior and during the toning process, some toner 18 and/or dust particles may accidentally reside on the back of the tape, that could readily interfere with the tape driving and transport functions. These unwanted particles are removed by vacuum cleaner 4. As indicated in FIG. 1 this vacuum cleaner includes a properly designed wedge or blade 19 which functions as a scraper to effectively dislodge substantially all the toner and dust particles riding on the back of the tape, thus ensuring proper tape transport operations.

Toner particles received by the rotating cylinder 27 of the scavenger roll are moved to a scraper 28 which cleans the cylinder 27. It will be appreciated that the scavenger roll, in returning the excess and background toner particles to the main toner supply, contributes to a higher toning efficiency, i.e. less toner waste.

Member 5 is specially designed to be provided in the toner bin in close conformity with the magnetic roll 22, which member separates the main toner supply area from the magnetic roll area and permits a controlled flow of toner to a preselected narrow section of the cylinder 29. In this way, a clean toning operation is maintained. The amount of toner (its depth) supplied to cylinder 29 is metered by an adjustable metering edge or doctor blade 30.

At the toning zone the desired magnetic field strength and configuration is established by properly selecting magnetic field strengths for magnets 11 and 12 and locating the high permeability member 2 at the back of the tape.

FIG. 2A depicts schematically the interaction between the magnetic roll magnets 11 and 12 via member 2 in terms of a magnetic field pattern. As shown, member 2 essentially provides the main path for the outer magnetic circuit of the magnets 11 and 12, directing the magnetic field in and out of the magnetic tape in a somewhat perpendicular fashion. Thus the existence of a relatively strong magnetic field at the location 14 is assured which inter alia enhances confinement of the toner particles at the exit of the toning zone and creates an increased toner pressure on the magnetic medium 6. At location 32, that is in between the magnets 11 and 12, the magnetic field strength is relatively weaker, which in turn causes the magnetic toner particles to be substantially freer and available for toning. Thus the magnetic latent image, coming in intimate contact with the relatively free toner particles in the vicinity of the location 32, becomes desirably somewhat excessively toned, without being subjected to detoning and/or demagnetizing magnetic field forces. As indicated above, the excessively toned image subsequently will be trimmed by the scavenging roll.

It has been found that proper positioning of the magnets 12 and 13, in respect to each other, results in magnetic field forces 35 acting on the loose and excess toner particles, allowing them to return to the magnetic roll (see also in particular the area designated by 26 in FIG. 1). It will be appreciated that such an arrangement, providing so-called self-scavenging, reduces or can even virtually eliminate the need for a scavenging roll 3. It should be noted, however, that the design of a magnetic roll with provisions for self-scavenging can become somewhat involved, since magnets 12 and 13 are both expected to satisfy additional requirements, the latter particularly in connection with member 5 (FIG. 1).

The combination of the opposite movements of tape 6 and cylinder 29 respectively and the creation of a predetermined magnetic field pattern as previously described and illustrated, results in a system of highly desired toner dynamics at the toning zone. The resulting outside canopy of the toner on the cylinder 29 and at the toning zone is generally shown in terms of dashed line 36 in FIG. 2A.

Figure 2B:
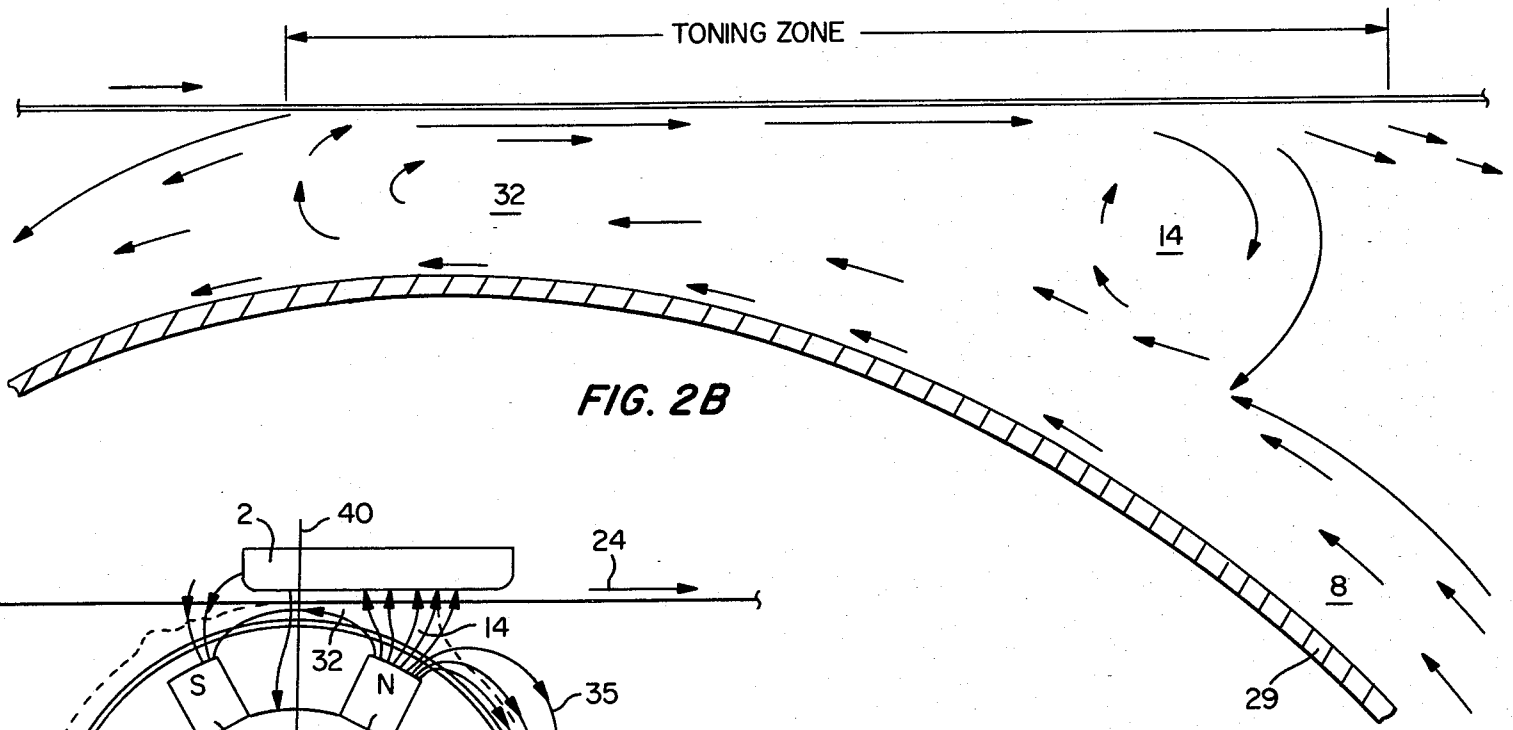
FIG. 2B depicts an enlarged side illustration of the toning zone and the toner dynamics for the arrangement according to the FIG. 1.
Figure 2A:
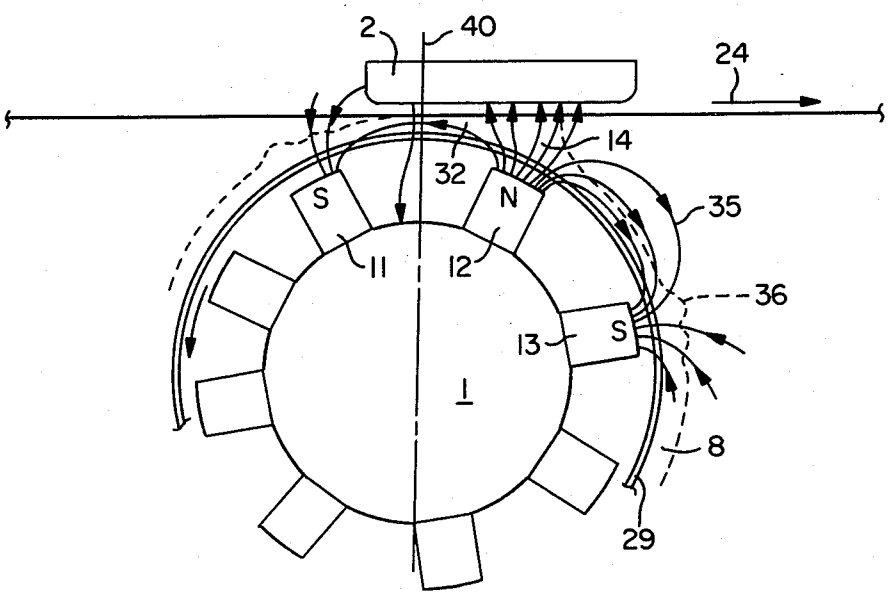
FIG. 2A illustrates the magnetic field pattern for toning a magnetic medium by the arrangement according to the FIG. 1.

FIG. 2B is an enlarged view illustrating the above-mentioned toner dynamics at the toning zone. Movement of the tape in the opposite direction to that of the magnetic roll forces the toner particles in the vicinity of 32 close to the surface of the tape to change direction of movement. The relatively strong magnetic force fields near the location 14 substantially confine and contain the toner particles that are moving with the tape thus effectively creating a rotating toner bead or dam at 14. Indeed these opposing movements of the toner particles at the toning zone contribute substantially to the properly fluidized toner state magnetically contained within the toning zone and readily available for developing the magnetic latent images.

As mentioned earlier, the magnetic enhancer 2 constitutes a significant portion of the magnetic circuit for magnets 11 and 12. Thus, its distance from the magnets 11 and 12 somewhat affects the magnetic reluctance associated to the magnetic circuit and, therefore, the field intensity at the location 14. It is noted that in positioning the magnet 12 toward the center axis 40 a somewhat similar result may be effected, although this could reduce the volume of free toner particles at location 32. The magnetic field enhancer, in urging the field of the magnet 12 to be substantially directed theretoward and perpendicular to the medium, effects longer range magnetic force fields toward the tape. A so-called magnetic brush results with relatively long toner bristols. Thus the magnetic tape pressing down, relatively speaking, on these toner bristols will give rise to a highly desirable continual pressure of toner particles at the surface of the magnetic medium. It will be further appreciated that with the aid of the magnetic enhancer, long range toner bristols can be generated without creating high horizontal magnetic field intensities, in the toning zone, that generally could undesirably demagnetize the magnetic latent images.

It is noted that the existence of appreciable horizontally directed (i.e. parallel to the plane of the tape) magnetic field forces in the toning zone having a magnetic field gradient toward the cylinder 29, would exert forces on the toner particles toward the cylinder 29 and, therefore, away from the magnetic medium. Such a condition is undesirable. The magnetic enhancer virtually eliminates this problem by providing a magnetic field pattern that favorably causes or substantially contributes to: (1) the toner particles at the toning zone to move in a direction toward the magnetic medium in a fluidized manner, (2) the toner particles to be confined and contained within the toning zone without introducing demagnetizing field intensities, and (3) the ability to provide fine adjustments for the field strength as may be needed.

Figure 3:
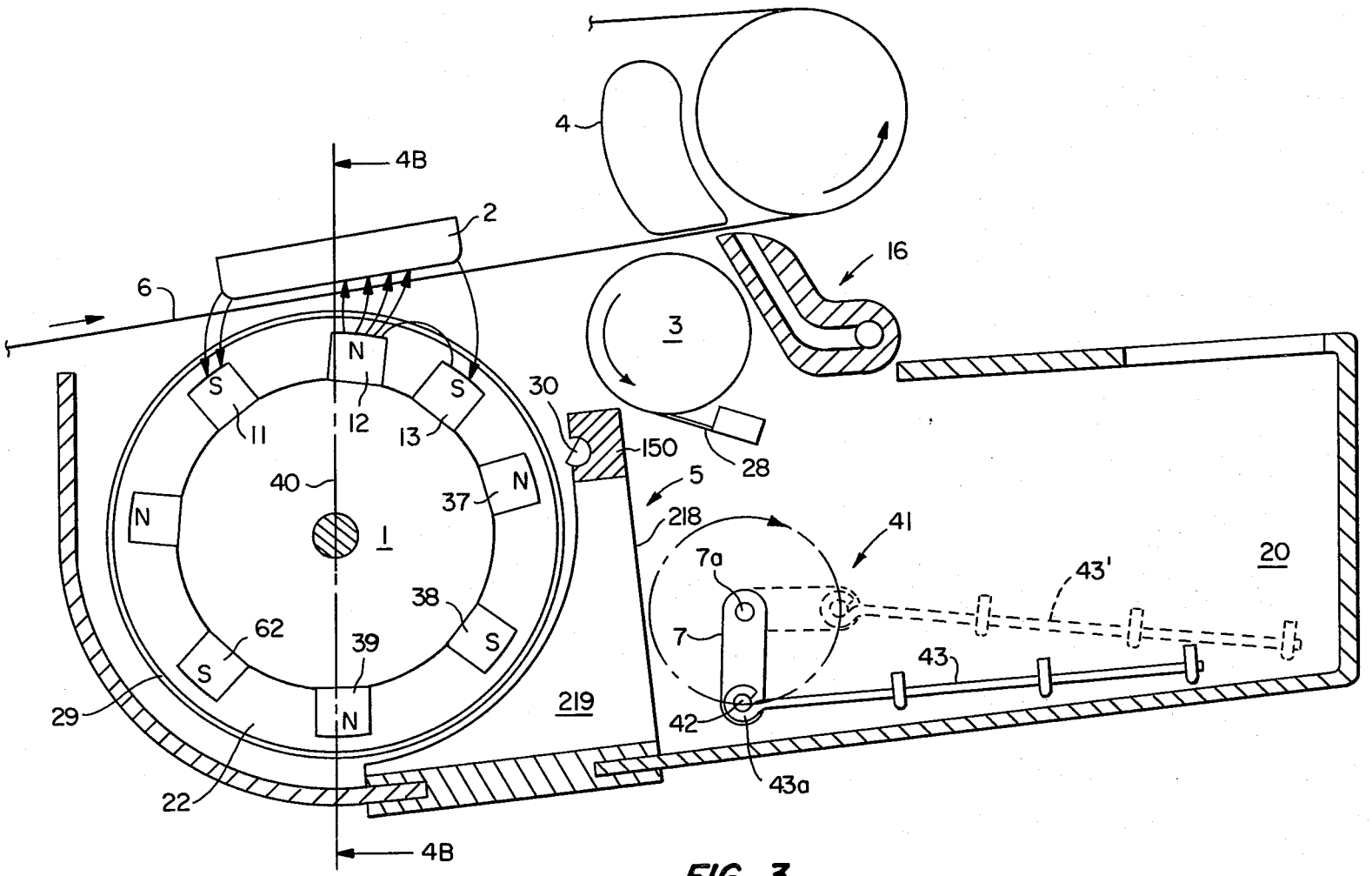
FIG. 3 structurally depicts a complete arrangement of a toning system in accordance with the concepts illustrated in FIG. 1.

FIG. 3 is a partially cross-sectioned side view of a complete toning or developing system or station in accordance with the invention, in a nearly horizontal orientation. The station includes a rake arrangement 41 functioning within the main toner supply area to facilitate the movement of toner toward the member 5 which controls the toner supply to the magnetic roll 22. This rake arrangement is comprised of a member 7 mounted for rotation about point *7a*, which generates an eccentric motion via a pivot pin 42. The actual structure of the rake itself is more precisely set forth in FIGS. 6A and 6B. As shown, in FIG. 3, the rake 43 is affixed to the pivot 42 by a curved end piece 43*a*. The eccentric motion provided by the member 7 and pivot 42 operates the rake favorably to urge the toner particles in the toner bin 20 to the channeling member 5. In this regard the rake 43 is illustrated in FIG. 3 also in a ghost position 43'.

The toner particles urged leftwardly in FIG. 3 by rake arrangement 41 are received in member 5 which defines a relatively narrow vertically oriented channel 219. A more complete understanding of the structure of channeling member 5 may be gathered from the illustration of this member in its closely conforming relationship to the magnetic roll or wheel 22 in FIG. 5.

Channeling member 5 is comprised of a unitary part 150 illustrated in cross-section in FIG. 3, which is mounted into the floor of the toner developer station to facilitate its positioning in relation to the magnetic roll. Member 5 defines via part 150 the vertically oriented narrow channel 219 which is funneled at its orifice 218 (FIG. 5) to readily receive the toner particles. The defined channel has a roof somewhat higher than the axis of the magnetic wheel 22 and a floor which lies closely below the outer surface of the lowermost point of the rotating cylinder or shell 29 of the magnetic roll. The channel extends leftwardly from the funneled opening to a parallel-walled portion, the toner-outflow port of which effectively wraps around the magnetic wheel from ceiling to floor in closely-defined and cooperating relationship with shell 29. There results a well established path for toner movement on the shell 29 of magnetic roll 22 between the same and the piece 150 of channel member 5. This path, as illustrated in FIG. 3, begins at a point proximate the lowermost point of shell 29, as governed by "magnetic valve" magnet 39, and gradually widens to a point where member 5 provides a metering arrangement 30. The path thusly defined is particularly important for a proper transport of the toner toward the toning zone, and thus the positioning of the magnetic wheel and the member 5 relative to one another is of considerable importance.

Figure 5:
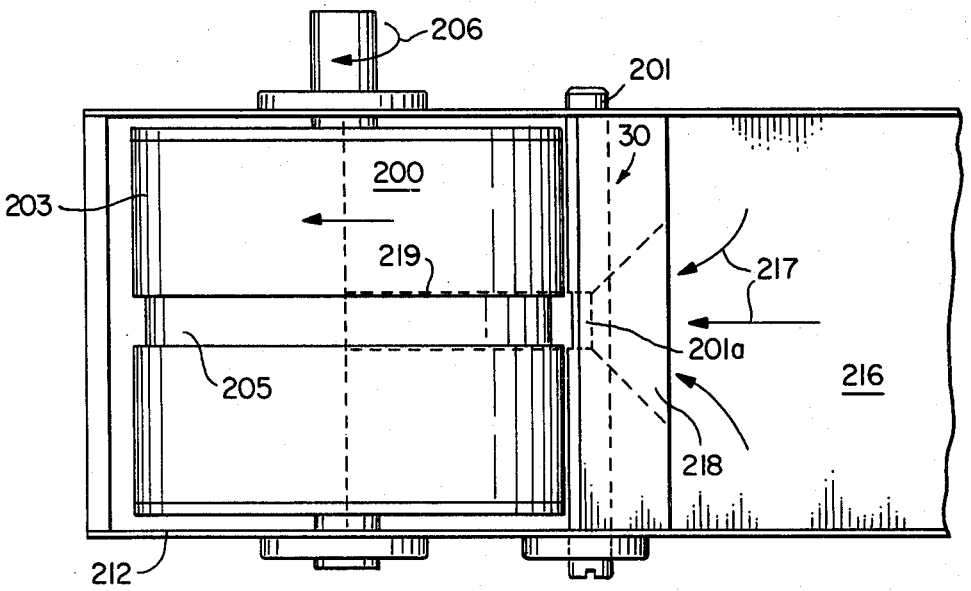
FIG. 5 is a top view of a portion of the toning system of FIG. 3, showing in particular the direction and control of toner flow from the toner bin toward the magnetic roll.

The height of the toner carpet formed on the magnetic roll 22 is controlled by adjusting metering rod 30, in particular by the position of its flat section relative to the toner flow path. This metering rod, housed in the member 5, extends beyond the side plate of the toning system to provide ready access for adjustment (FIG. 5). The magnet 37 situated opposite to the metering rod facilitates the metering action, as mentioned before.

With regard to the magnetic roll arrangement 22, magnet 39, located at the lowermost part of the opening of the channel of member 5 to the magnetic roll, acts like a magnetic valve to prevent uncontrolled flow of toner from the main toner supply into the leftward portion of the housing of the developer station associated to the magnetic roll. Magnet 38 interacts with magnets 39 and 37, and attracts toner to the magnetic roll and prevents lateral seepage of toner on the magnetic roll to ensure a proper toning operation relative to the width dimension of the magnetic medium and cleanliness. As depicted in FIG. 3, magnet 12, for example a barium ferrite (e.g., Permag's ceramic V) magnet, is positioned nearly at the vertical axis 40 for effecting satisfactory development of say a $CrO_2$ magnetic medium. The magnetic field pattern for this arrangement is, as before, demonstrated by the field lines provided. When the lead magnet 12 is placed proximate to the centerline 40, as shown, the toner particles in toning region are caused to bristle, in following the magnetic lines of force between the lead magnet 12 and the back member 2, thereby effectively creating a magnetic brush of particles for uniformly toning (developing) the magnetic latent images on the tape segment in the toning region.

Figure 4B:
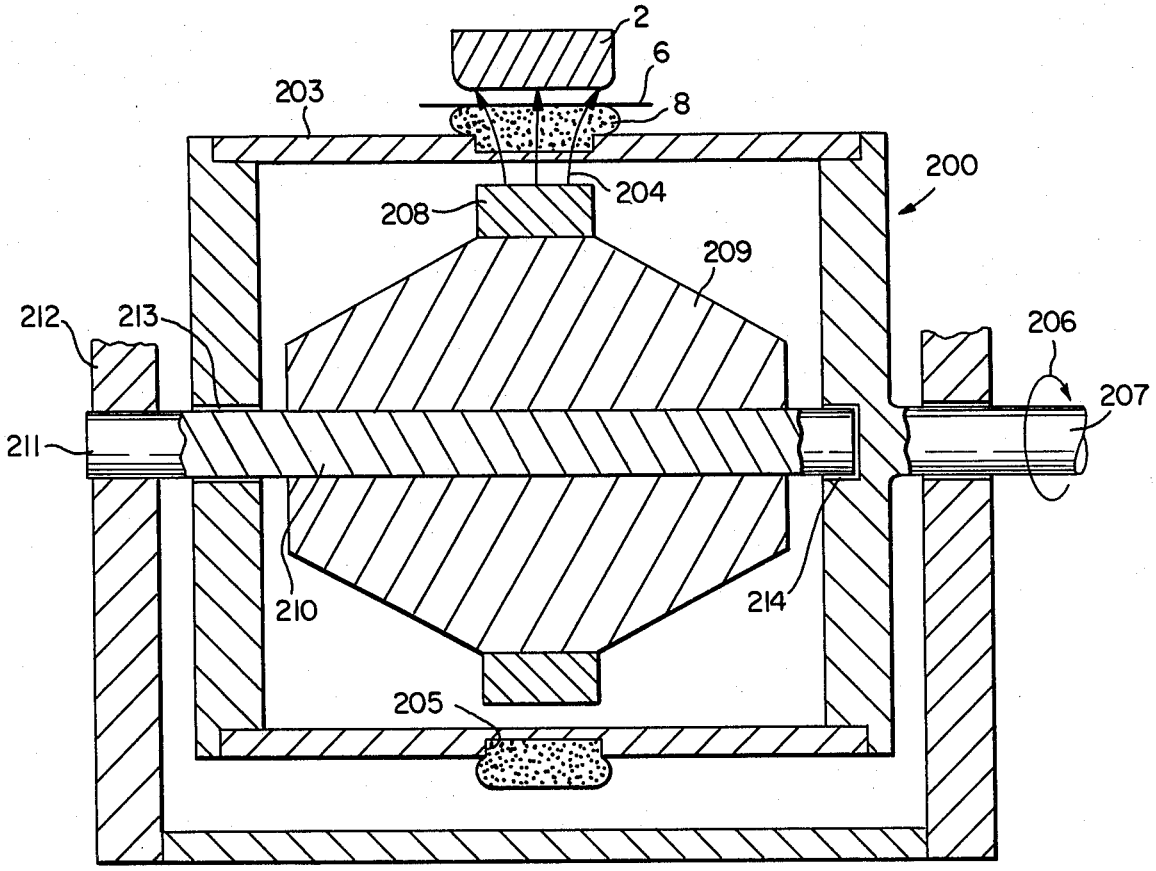
FIG. 4B shows a cross-sectional view of a construction of a magnetic roll housed in the main body of the toning system of FIGS. 1 or 3.
Figure 4A:
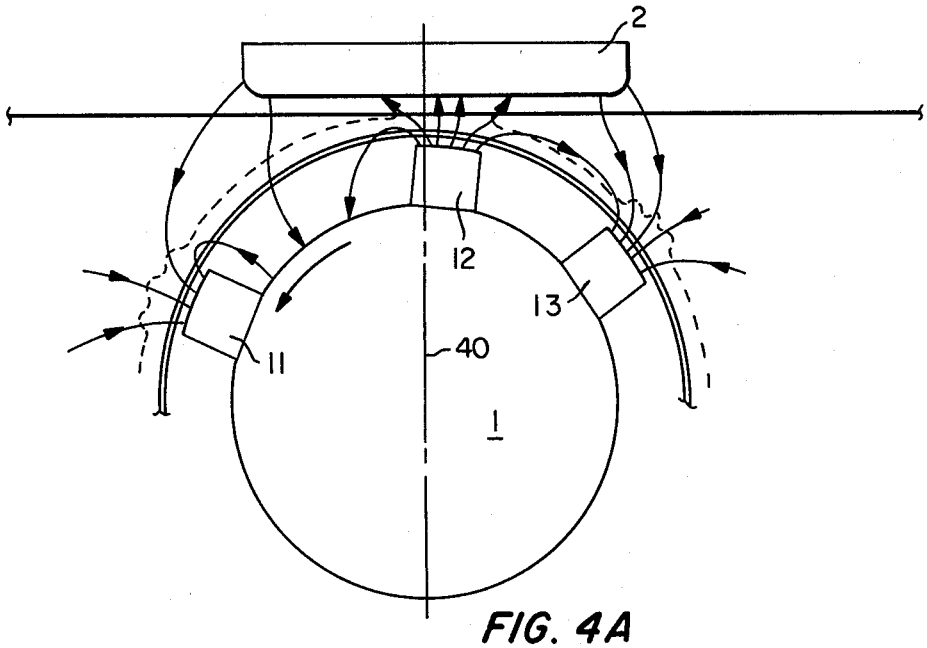
FIG. 4A illustrates a magnetic field pattern of the toning zone similar to that depicted in FIG. 3, which is particularly effective in providing a self-scavenging function.

FIG. 4A depicts the magnetic field pattern for a magnetic roll arrangement similar to that shown in FIG. 3. The arrangement of FIG. 4 differs from that of FIG. 3 only in that an entirely horizontal operation is contemplated and the position of magnet 11 has been moved away from lead magnet 12 somewhat. Similar to the previous arrangements, magnets 11 and 12 with the enhancer 2 define the toning zone, and the combination of the magnets 12 and 13 interacting via magnetic enhancer 2 create magnetic field forces at the exit of the toning zone to collect the loose toner particles back onto the magnetic roll for return to the toner supply.

However, in the embodiment of FIG. 4A, the position of magnet 13 relative to elongated enhancing member 2, is particularly effective in minimizing air-borne toner and maximizing the removal of excess toner particles from the developed images.

The strong vertical field components created cause toner particles to form chains or bristles which are stable and resist mechanical disturbance by high speed motion of the tape. When this condition is established, toner which would otherwise deposit in background areas is held onto the chain ends. The need for scavenging is thus virtually eliminated and little or no vacuum cleaning is required. Toner use efficiency is correspondingly high.

FIG. 4B illustrates a cross-sectional view of the detailed arrangement of a magnetic roll 200 and its relationship in respect to the magnetic tape 6. As shown, the magnetic toner 8 is secured on the cylinder 203 of the magnetic roller by the magnetic field forces 204. The cylinder surface 203 may be centrally grooved (as shown at 205) to provide a confining path to the toner particles. Its contribution becomes important at the toning zone especially in cases in which reduced magnetic field forces are there utilized. As indicated previously, the magnets 208 are stationarily arranged relative to the rotating cylinder 203 by affixing same on a soft iron magnetic roll core 209 which in turn is fixed on a shaft 210 that is clamped and secured to the main frame 212 of the developer at 211. The cylinder 203 rotates, in a predetermined direction 206, on the bearing surfaces 213 and 214. The rotating power is applied via shaft 207.

As shown in FIG. 4B, the thickness of back member 2, the width of the groove 205 and the length or pole width of the magnets 11–13 and 37–39 are made to correspond to each other and to the height of the desired number of lines of latent character images on the tape 6. It is understood that the width of groove 205 may be expanded to correspond to more than one line of latent character images.

It has been found that a particularly effective high-quality toning operation, with the generation of virtually no air-borne toner and little or virtually no background toner, is achieved with an arrangement according to the invention such as is illustrated in FIG. 3, in connection with the following parameters:

A. for the separation distance between back member 2 and the magnetic medium: 0.1 to 0.25 inches;

B. for the distance between the surface of the operative pole face of lead magnet 12 to the outer surface of the cylinder 29 of the magnetic roll 22: 0.065 to 0.150 inches;

C. for the separation distance between the magnetic medium 6 and the most proximate point of the outer surface of the magnetic roll cylinder 29: 0.04 to 0.05 inches;

D. for the lead magnet 12 dimensions:
height or length 0.19 to 0.20 inches;
pole face dimensions:
parallel to direction of medium movement: 0.19 to 0.20 inches;
perpendicular to the direction of medium movement: 0.25 inches;

E. for the field strength of the lead magnet at its pole face: 1,300 to 1,500 gauss;

F. for the depth of toner on the cylinder 29 permitted by metering rod 30: 0.005 inches less parameter C above.

G. for the angle which the orientation of the lead magnet forms with the line perpendicular to the medium at the point where the cylinder 29 is most proximate to the medium: 2.5° to 30°.

It has been found that an especially preferred range of parameter G is $3° \leqq \theta \leqq 15°$. In this range particularly, well-defined, strong bristles of the magnetic brush are achieved, substantially perpendicular to the tape medium, high toner optical density is realized, and minimal background in terms of wasted toner (i.e., toner lost to the system via the vacuum) is experienced.

FIG. 5 illustrates a preferred arrangement for channeling the supply of toner to the magnetic roll to form a well defined and confined so-called band of toner on the cylinder 203. The channeling arrangement is such that the toner in the main supply 216 moves in the general direction indicated by arrows 217 into funnel 218 which directs and supplies toner into narrowed channel 219 and onto the magnetic roll 200 restricted and confined within the desired width. If a groove 205 is employed, the channel 219 is dimensioned to substantially correspond thereto and both are dimensioned in width to correspond to the width of the portion of the magnetic medium desired to be toned. As shown, the channel 219 extends from the funnel 218 and is shaped around the magnetic roll to restrict and control delivery of toner only to the center area of the cylinder or shell 203 (and to the groove 205 if employed). In this way there is avoided lateral toner transport and thus the uncontrolled transport or spreading of toner to for example the spaces between the magnetic roll and the main body of the developer. As shown also, the channeling arrangement further includes the rotatably adjustable metering device 201 which is comprised of an elongated narrow cylindrical rod having a centrally disposed flattened or recessed area 201*a*. Metering rod 201 is arranged just above the highest point (see FIG. 3) of the channel 219 to adjustably control the depth of the toner particles advancing upward along the outer surface of the magnetic roll.

Figure 6A:
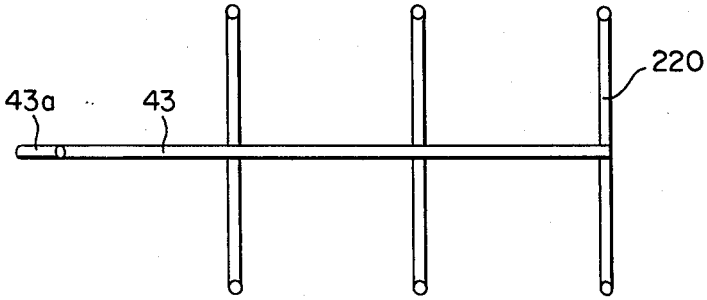
FIGS. 6A and 6B illustrate in top and end views the detailed design of the toner moving arrangement in the form of a rake, as shown in FIG. 3.
Figure 6B:
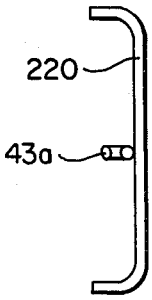

FIGS. 6A and 6B depict in top and end views the simple but effective rake design 220 previously illustrated in FIG. 3 for effecting movement of the toner particles in the toner bin 216 toward the funnel 218 of channeling member 5. Such a device can be constructed from say 0.1 inch diameter pieces of wires that are bent to form the depicted u-shaped tines and spot welded to a straight piece of similar wire. The rake design is shown directly and in phantom in FIG. 3, wherein this toner-moving device 41 is disposed substantially directly in front of the funnel portion 218 of the channel 219 (FIG. 5) for moving toner from the sump or toner bin 20 (FIG. 3) through the channel 218, 219 toward the drum 29 where it is attracted to the outer drum surface by the effect of the stator magnets 11–13 and 37–39.

As shown in FIGS. 6A and 6B, the device 41 is comprised of the elongate portion 43 and the transverse portions or tines 220 disposed orthogonal to the elongate portion and rigidly affixed to said elongate portion at selected uniform distances along the length of the elongate portion. As shown, the device 41 also includes arm portion 7 fixed to a shaft 7*a* for rotation therewith. A motor (not shown) coupled to the shaft 7*a* provides rotational motion to the shaft. The arm portion 7 includes a rigid (non-rotating) shaft portion 42 about which an end portion 43*a* of the toner-moving device or rake member 41 is hooked for sliding motion (two dimensional translational motion) thereabout. As a result of the rotational motion of arm portion 7, the elongate and transverse portions 43, 220 of the rake member 41 are moved downward (deeper into the toner) and toward the channel 219 (FIG. 5) for moving or raking a batch of toner into the channel toward the drum 129. The continued rotation of the member 7 effects a lifting action of the leftward portion of the rake and a rightward movement of the rake in this orientation. As a result, the rake is moved upward and away from the channel 177 in preparation for raking another batch of toner, while minimizing the amount of movement of toner in a rightwardly direction. As shown in FIG. 6A, the end portions of the transversely disposed tooth portions 220 of the rake member 43 are turned or curved upward at a selected angle to provide a vertically acting component for more effective movement of toner toward the drum 29.

Figure 7:
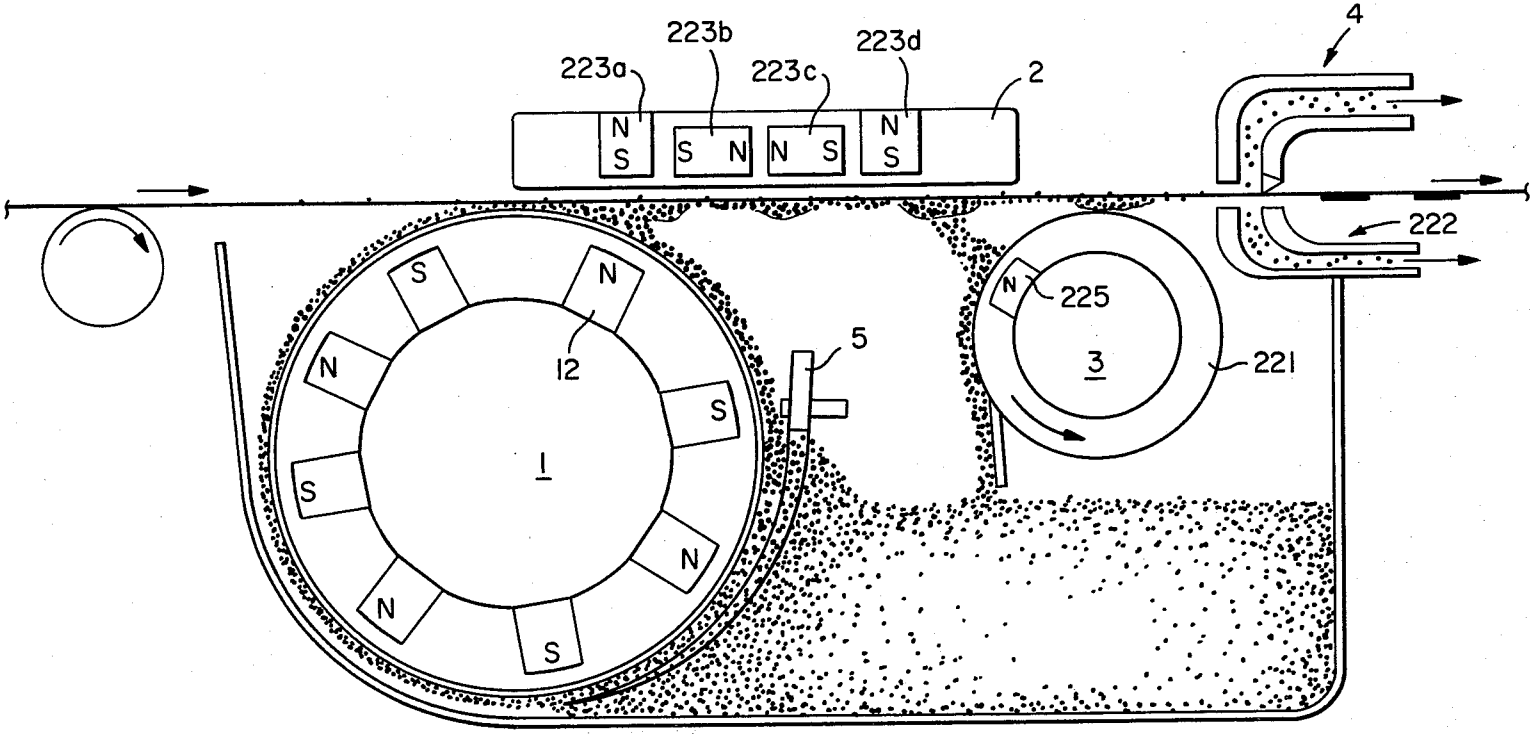
FIG. 7 shows an alternative embodiment of the developer system of FIG. 1 in which the magnetic field enhancer interacts with both the magnetic roll and the scavenging roll to control and remove air-borne and excess toner particles.

FIG. 7 illustrates an alternative arrangement of magnetic enhancer 2, and in particular an alternative technique for controlling the heretofore-mentioned airborne toner particles (of FIG. 1) and removal of the excess toner from the magnetic medium, which technique makes use of the magnetic enhancer 2. Essentially this method is based upon the creation of magnetic forces acting on the toner particles in a direction that is substantially normal to the surface of the magnetic medium, extending from the magnetic roll to the cleaning or scavenging roll 221. The magnetic field forces at the cleaning roll are arranged to effect transfer of the loose toner particles, comprising the excessive and background toner, to the cleaning roll shell. Thus it is intended that the magnetic medium leave the cleaning roll with minimal excessive and background toner, which would at any rate be subsequently removed by the vacuum cleaner 222.

The forming of a bridge of toner between the tape and the scavenger is vital to effecting a scavenging action whereby substantially all background toner can be removed. The high field gradients produced by the chaining toner captures the background toner particles.

It is understood that the magnitude of the magnetic forces exerted on a toner particle that is responsive to a magnetic field is proportional to the product of the magnetic field strength and its spatial gradient. Thus to create relatively strong magnetic forces acting on the toner particles without weakening or degradating the magnetic latent images, it is of advantage to maximize the spatial magnetic field gradient along the magnetic medium in between the magnetic roll and the cleaning roll. This is accomplished in terms of arranging magnets 223*a–d* to face each other with the same polarity poles. This tends to direct the magnetic fields out and away from each other creating relatively long range and high spatial field gradient. However, the magnets 223*a* and 12 face each other with different polarity poles which causes the above-discussed magnetic forces extending from the magnetic roll through the magnetic medium to enhance the toner brush and to increase the upward force component on the toner particles in contact with the medium. A similar arrangement is considered for the magnets 223*d* and 225, resulting in magnetic forces operating on the toner particles which extend from the magnetic medium to the cleaner roll.

Figure 8:
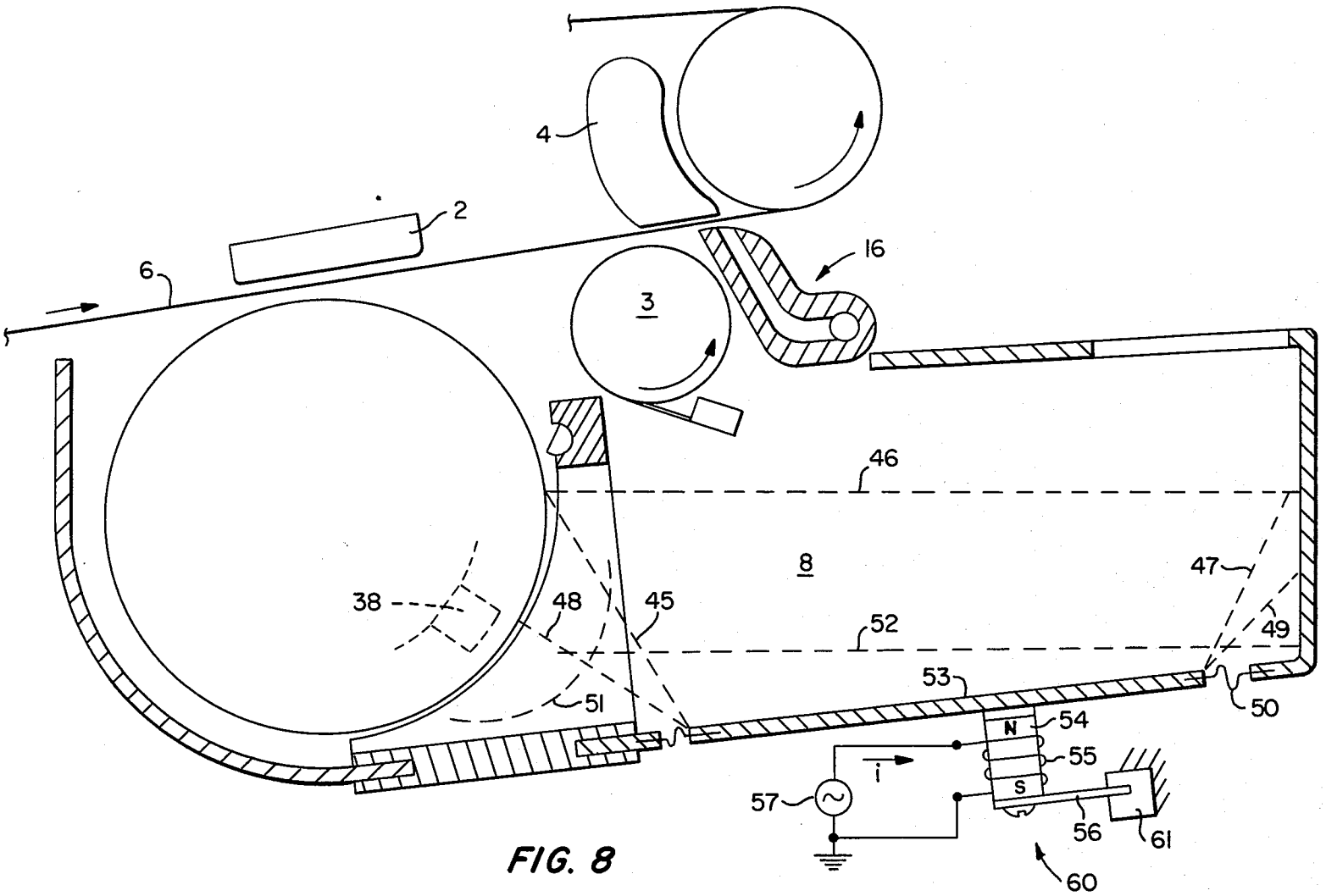
FIG. 8 depicts an alternative method for effectively facilitating transport of toner from the toner bin to the magnetic roll.

FIG. 8 illustrates an alternative method for the transport of the toner particles from the main toner supply to the magnetic roll. In this arrangement, the floor of the toner bin is provided with a resiliently mounted platform 53 which is urged to oscillate at frequencies of nearly 60 Hz to fluidize the toner that could respond to the gravitational forces. It is found that when such a system is properly operated the volume of toner within the dashed boundary lines 45, 46 and 47 becomes substantially completely fluidic. The volumes within the dashed boundary lines 45–48 and 47–49 become partially fluidic. That is, the toner can flow under a relatively small assisting force. Magnet 38, having an attractive force range indicated by dashed line 51, provides such an assisting force. In this arrangement it is intended to utilize the volume of toner contained within the dashed boundaries 46, 47, 48 and 52.

As shown in FIG. 8 the floor 53 of the toner bin is secured to the main body of the developer by appropriately constructed flexible members 50. To provide the oscillating function for the platform 53 thusly mounted, a linear motor 60, as example, is coupled between the movable platform 53, on the one hand, and stationary member 61 which may be a part of the frame of the apparatus, on the other hand. Linear motor 60 is comprised of a magnet 54 wrapped by a coil 55 which is powered by an oscillating current source 57. In particular, the armature 54 is secured to the stationary member 61 via a spring leaf 56. The oscillating magnetic field of the coil 55 interacting with the magnetic field of magnet 54 causes an oscillating force that directly acts on the platform 53. It is found that as a design criteria the onset of fluidation of the toner 8 occurs when $$A_o W^2 > g$$

where, $A_o$ and W are the amplitude and frequency of the oscillation respectively, and g is gravity.

Figure 9:
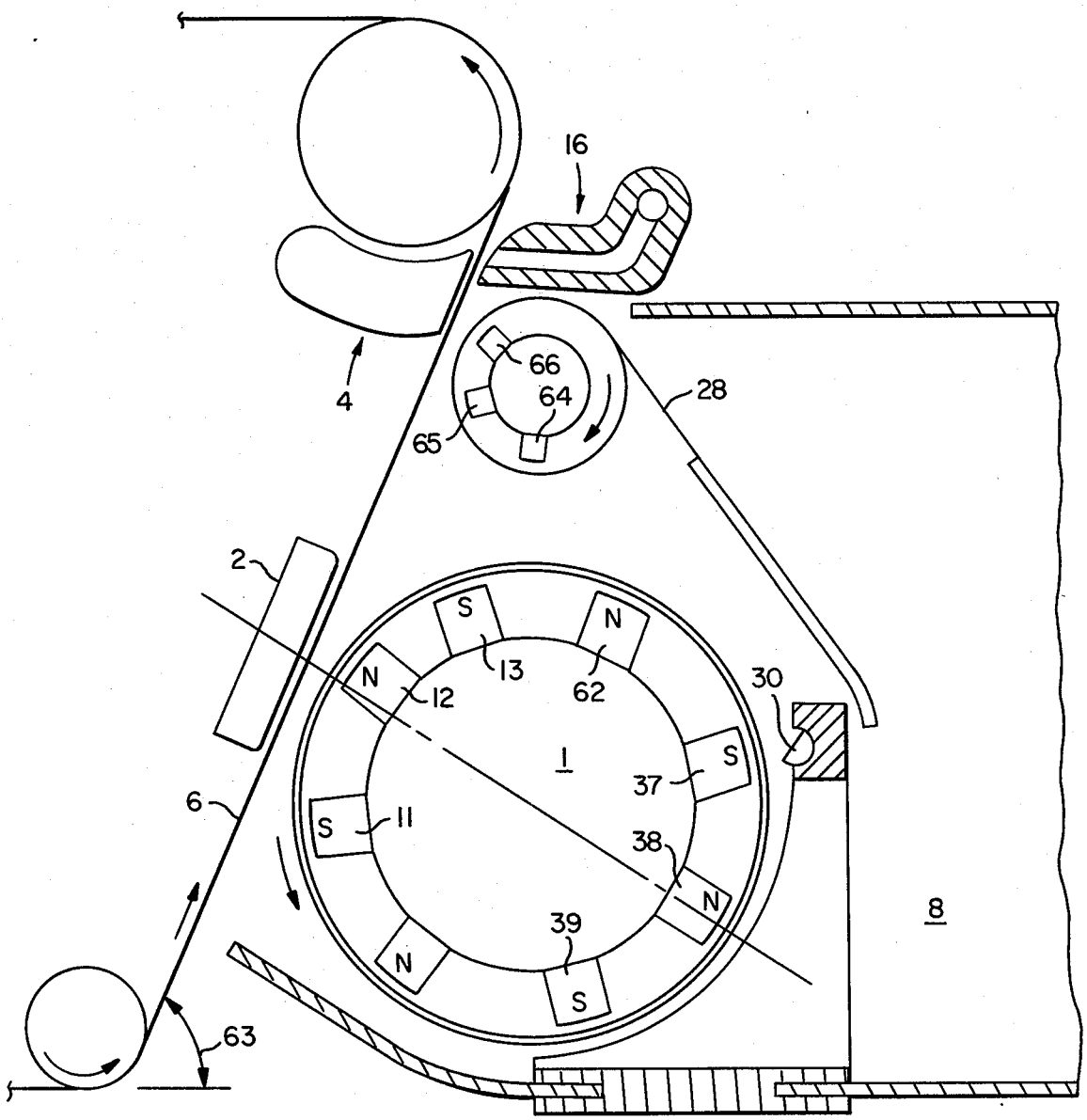
FIG. 9 illustrates a variation on the design of a toning system, in accordance with the concepts depicted in FIGS. 1 and 3, when a steep operating angle associated to the magnetic medium is needed.

FIG. 9 shows a variation on the design of a toning system according to the invention where the angle 63 of operation is nearly vertical as compared with the previously described substantially horizontal version shown in FIG. 3. Indeed, the concepts concerning toner transport, toning and cleaning are essentially the same as for the horizontal design. However, rearrangement of the magnets on the core 1 results in magnet 62 being positioned between magnets 13 and 37 to facilitate transport of toner from the metering rod 30 to the toning zone which is now a longer distance. The magnet arrangement at the toning zone remains essentially the same as that of the design shown in FIG. 3 relative to the medium 6 and the member 2.

To ensure fully effective performance of the scavenging roll in this design the direction of its rotating cylinder is changed to the clockwise direction to appropriately return the excess toner to the main toner supply. In the embodiment of FIG. 9, the scavenging roll includes three smaller magnets 64, 65 and 66. The combination of magnets 64 and 65 provides magnetic force fields which are particularly effective in collecting the aforementioned air-borne toner particles. The combination of magnets 65 and 66 provides an adequate magnetic force field for effectively accomplishing the cleaning function without the danger of weakening the latent magnetic images of the medium 6. Finally, magnet 66 provides an effective means for transporting the excess toner to the scraping blade 28.

In connection with the toning of high quality magnetic latent images, there has been provided herein, in accordance with the invention, arrangements comprising a combination of suitably arranged magnets with a magnetic field enhancer member at the toning zone to create a fluidized volume of toner that is contained magnetically for effectively developing magnetic latent images without subjecting the images to weakening and potentially destructive external magnetic fields. With particular regard to toning efficiency of the toning system, there has been herein provided according to the invention, a cleaning or scavenging arrangement capable of removing and reclaiming substantially all the excess and air-borne toner created in the developing process. In accordance with the invention, the toner image is finally processed by a vacuum cleaner, under a magnetic field free condition, to remove any remaining background toner, thus ensuring high quality toned images.

Therefore, the invention provides a full toning applicator system capable of toning magnetic latent images with dry magnetic particulates toner efficiently without causing image degradation, which design can readily lend itself to commercial applications.

What is claimed is:

1. In apparatus having a movable magnetizable medium capable of carrying latent magnetic images, magnetically attractable toner particles capable of developing the magnetic images of said medium and magnetic roll means for bringing said toner particles from a relatively remote location into continuous operative contact with said medium, the improvement comprising an eccentrically mounted and operated rake arrangement having a center wire stem and a plurality of transversely oriented curved wire tines, for urging toner particles into contact with said magnetic roll.

2. An apparatus according to claim 1 wherein said rake arrangement is disposed in a toner bin and further including channel means shaped to conform to said magnetic roll and positioned to accept toner urged toward said magnetic roll by said rake arrangement, for providing a predeterminably shaped and dimensioned funneled channel for permitting the toner particles in the toner bin to reach said magnetic roll and be deposited thereon in a band dimensioned relative to the width dimension of the medium.

3. An apparatus according to claim 2 wherein said channel means includes adjustable metering means for controlling the depth of toner particles transported on the magnetic roll.

4. In a system for developing latent magnetic images on a movable magnetizable medium with magnetically attractable toner particles in which the toner particles are caused to be transported via a magnetic roller which consists of a core having a plurality of stationary magnets radially arranged relative to a center point of said core with each of said magnets being oriented to provide a pole face away from the center point and the outward pole faces are of alternate polarity, and which also consists of a non magnetic shell normally rotating about said core to carry toner particles held against said shell by the magnetic fields of said magnets from a toner reservoir to a toning zone next to said medium whereas said toner is brought into intimate contact with the magnetic images to develop same, the improvement comprising:

Magnetic enhancing means arranged proximate to said toning zone and to said magnetic roll such that said magnetizable medium is disposed between said shell and said enhancing means, said enhancing means effecting a concentration of the magnetic field pattern between the two of said plurality of magnets closest to said medium, which two magnets are positioned such that a radial line extending from the center of said core to each said two magnets each form an angle with respect to another radial line which is perpendicular to said medium, and said last mentioned magnetic field pattern is concentrated in two relatively narrow bands substantially perpendicular to said medium, one band from each of said two magnets, wherein the space between said two concentrated magnetic field bands defines said toning zone which has very little magnetic field therein to affect said toner, and said toner in said concentrated magnetic field bands form stable bristles that resist mechanical disturbance, to thereby confine said toner in said toning zone and collect loose toner that is deposited on non magnetized background around said magnetic images as said developed images exit said toning zone.

5. The system in accordance with claim 4 wherein said magnetic enhancing means comprises a member made of a relatively high magnetic permeability material for effecting the concentration of said magnetic field pattern between said two magnets closest to said medium to define said toning zone which in itself is relatively free of said magnetic field.

6. The system in accordance with claim 4 wherein said magnetic enhancing means comprises magnet means for effecting the concentration of said magnetic field pattern between said two magnets closest to said medium to define said toning zone.

7. The system in accordance with claim 6 wherein said magnet means comprises a magnet having at least two poles with one pole thereof being closest to a first one of said two magnets on said core closest to said medium where the polarity of said one pole is opposite the polarity of the pole of said first magnet which is closest to said medium, and the other pole of said magnet means being closest to the second one of said two magnets where the polarity of said other pole is opposite the polarity of the pole of said second magnet which is closest to said medium.

8. The system in accordance with claims 5 and 7 including scavenger means proximate to said medium and downstream from said toning zone to remove excess toner from said medium, and wherein said enhancing means is elongated and extends from said toning zone along said magnetizable medium in the direction of movement of the medium to the vicinity of said scavenger means to effect a continued attracting magnetic influence on the toner already in contact with the magnetic images on said medium to both minimize degradation of the toner image as said medium moves away from said toning zone and to minimize any of said toner on said medium becoming airborne.

9. The system in accordance with claims 4 and 7 wherein said magnetic enhancing means further comprises a plurality of permanent magnets between said toning zone and said scavenger means, with like poles of said last mentioned magnets being adjacent to each other causing the magnetic fields created thereby to be substantially normal to the surface of said magnetic medium and thereby exert a continued attracting magnetic influence on the toner already in contact with said magnetic medium and thereby minimize degradation of the toner image and to substantially suppress said airborne toner.

* * * * *